US006739462B1

(12) United States Patent
Kelly

(10) Patent No.: US 6,739,462 B1
(45) Date of Patent: May 25, 2004

(54) DISPLAY DEVICE FOR GOLFING-RELATED ITEMS

(76) Inventor: David W. Kelly, 1470 Hunt Club Dr., Wooster, OH (US) 44691

( * ) Notice: Subject to any disclaimer, the term of this patent is extended or adjusted under 35 U.S.C. 154(b) by 0 days.

(21) Appl. No.: 10/211,068

(22) Filed: Aug. 2, 2002

(51) Int. Cl.[7] ..... A47F 7/00
(52) U.S. Cl. ..... 211/163; 211/14; D6/552
(58) Field of Search ..... 211/14.15, 163, 211/49.1, 59.2; D6/552

(56) References Cited

U.S. PATENT DOCUMENTS 2,221,704 A * 11/1940 Farley
2,756,914 A * 7/1956 Bonderer
4,082,209 A * 4/1978 Sanders
4,784,305 A * 11/1988 Schoenberg
4,892,197 A * 1/1990 Slattery et al. ..... 211/14
D401,459 S * 11/1998 Tate ..... D6/552
D405,293 S * 2/1999 Tate ..... D6/552 X
6,085,937 A * 7/2000 Hutchinson et al.

* cited by examiner

*Primary Examiner*—Robert W. Gibson, Jr.
(74) *Attorney, Agent, or Firm*—Renner, Kenner, Greive, Bobak, Taylor & Weber

(57) ABSTRACT

Herein is provided a display device for golfing-related items comprising a housing defining a periphery; a plurality of golf ball channels partially open to said periphery and receiving golf balls therein such that said golf balls are viewable through the portion of the golfball channels that opens to said periphery; and at least one item-retaining member selected from the group consisting of a score card slot retaining scorecards, a bore retaining ball markers, a pencil slot retaining score card pencils, a business card slot retaining business cards, and means retaining a divot repair tool.

9 Claims, 3 Drawing Sheets

DISPLAY DEVICE FOR GOLFING-RELATED ITEMS

BACKGROUND OF THE INVENTION

The present invention generally relates to display devices, and, more particularly, relates to a display device for golfing-related items, such as golf balls, score cards, divot-repair tools, and ball markers.

At the home or office it is common to have an object on display that appeals to an interest of its owner, and which, upon being viewed by a guest, might bring about the initiation of a conversation based upon that interest. Such "conversation pieces" provide a topic of conversation and often times help one to establish a rapport with a guest or client or other invitee into the home or office.

Regarding topics of conversation, there is no doubt that most golfers, whether recreational golfers or serious players, enjoy talking about the sport, and particularly enjoy sharing information on various courses that they have played. Indeed, it is common for golfers to collect and display golf balls and score cards and other golfing-related items that bear an indication of the golf course at which they were obtained. Most golf courses now provide golf balls that contain a symbol that identifies that particular golf course, and divot-repair tools and ball markers can typically be found bearing similar indicia. Additionally, many companies provide golf balls and other golfing items that bear a company logo, and these items are also collected by many golfers. Thus, the present invention provides a type of conversation piece that is specifically tailored to retain such items and display them in an elegant manner.

As mentioned, it is common for golf courses to offer golf balls and other golfing-related items bearing the name of the golf course, and it is common for golfers to collect such items. Thus, it is another aspect of the present invention to provide a display device that is not necessarily for use only as a "conversation piece," but is alternatively useful as a sales display for such indicia-bearing golf items.

SUMMARY OF THE INVENTION

In general, the present invention provides a display device for golfing-related items comprising a housing defining a periphery; a plurality of golf ball channels partially open to said periphery and receiving golf balls therein such that said golf balls are viewable through the portion of the golf ball channels that opens to said periphery; and at least one item-retaining member selected from the group consisting of a score card slot retaining scorecards, a bore retaining ball markers, a pencil slot retaining score card pencils, a business card slot retaining business cards, and means retaining a divot repair tool.

In particular embodiments, the present invention provides a rotary display device for golfing-related items. The display device includes a base; a rotary housing defining a periphery, said rotary housing being rotatably associated with said base; and a plurality of golf ball channels partially open to said periphery of said rotary housing and capable of receiving golf balls therein. In this embodiment, a golf ball may be received in one of the plurality of golf ball channels such that a portion of the golf ball would be viewable through the portion of the golf ball channel that opens to the periphery of the rotary housing. In this manner, golf balls may particularly be oriented in the golf ball channels to display any logo or other indicia that might make that golf ball novel. Most typically, the indicia would indicate a golf course name or company logo or would present the name of the golf course at which it is being offered for sale by being displayed in the display device of this invention.

The housing, whether rotary or not, preferably displays more than just golf balls, and, therefore, is preferably configured to include one or more, most preferably all, of the following: a score card slot extending downward from the top surface of the housing for receiving a plurality of golfing score cards; a utility slot extending downward from the top surface of the housing for receiving items such as business cards or golfing pencils; a plurality of bores extending into the housing for receiving ball markers; and similar means for receiving a divot repair tool.

When used as a conversation piece at a home or business, the owner of the display device of this invention may collect and display novelty golf balls that bear the name of courses at which he or she has played, and, in particular embodiments of this invention, may further display scores cards, ball markers, divot repair tools and pencils from those courses. Particularly when employed at a place of business, business cards could also be displayed. When employed as a sales display, for instance, in the pro shop at a golf course, the same items would be displayed; however, each of the items, golf balls, ball markers, score cards, etc., would identify the particular golf course at which they are being sold, while, when employed as a conversation piece, each golf ball, ball marker, etc., would most likely bear the name of a different golf course or would display a different company logo in order to present the owner's collection thereof.

PREFERRED EMBODIMENT FOR CARRYING OUT THE INVENTION

Figure 1:
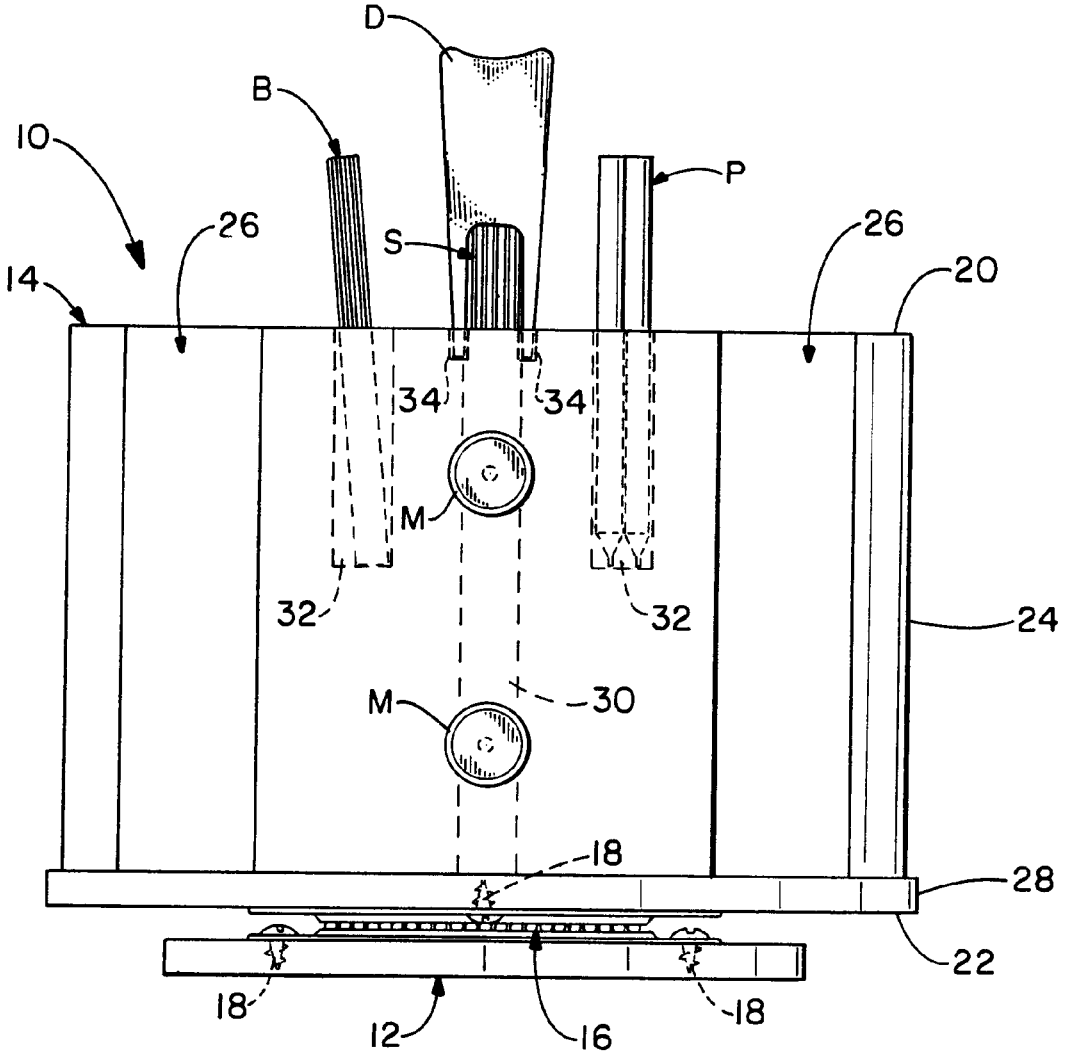
FIG. 1 is a elevational view of the display device of this invention, shown including a divot repair tool, ball markers, score cards, business cards, and golfing pencils therein.
Figure 2:
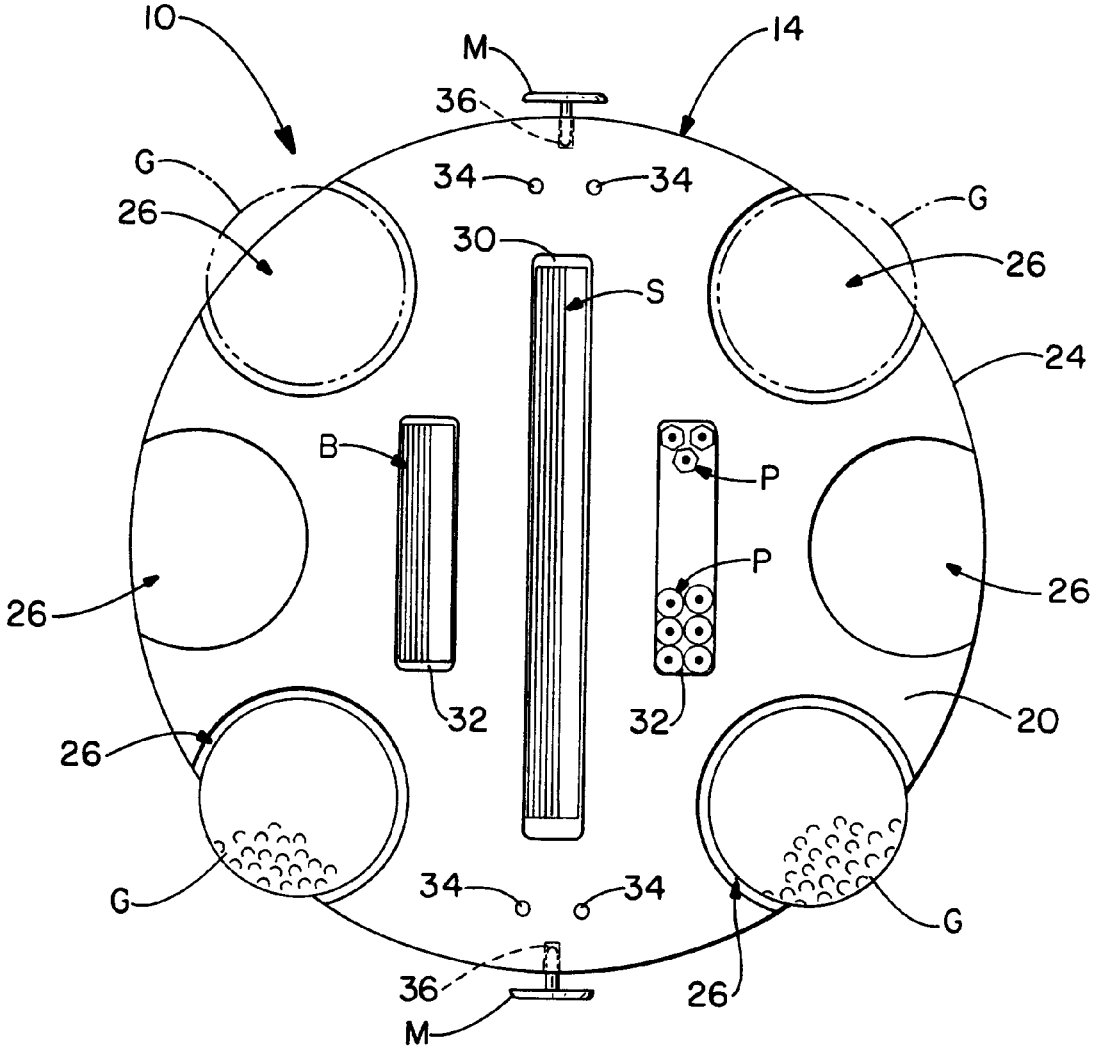
FIG. 2 is a top plan view of the display device of FIG. 1, shown without the divot repair tool but with golf balls received therein.
Figure 3:
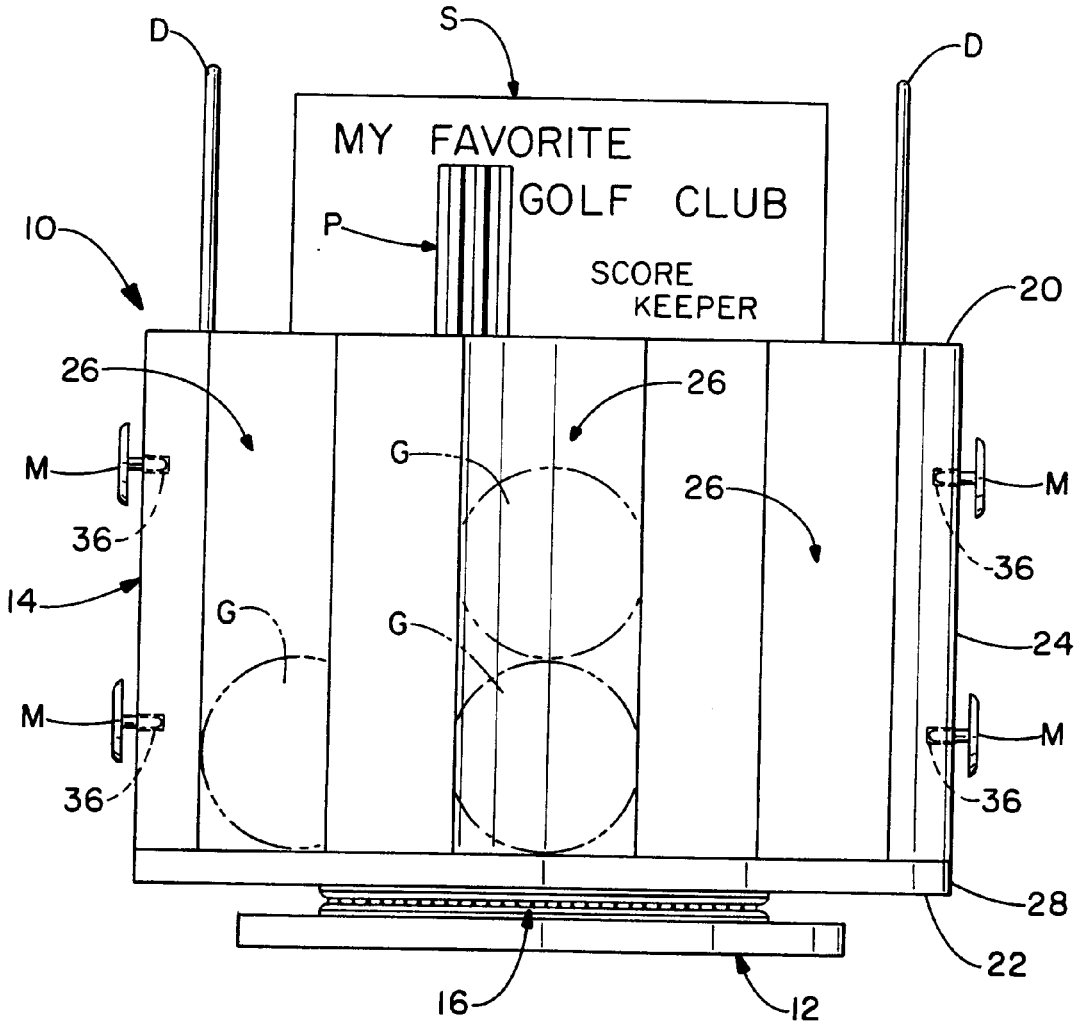
FIG. 3 is an elevational view of the display of FIG. 1, shown from a different position of view.

Referring to FIGS. 1–3, it can be seen that the display device of this invention is generally indicated by the numeral 10. Display 10 includes base 12 and rotary housing 14 joined thereto by ball thrust bearing 16 and appropriate fasteners 18. Ball thrust bearing 16 functions in a known manner, such that rotary housing 14 rotates about its axis on base 12. It should be appreciated that ball thrust bearing 16 is merely a preferred means for fixing rotary housing 14 on to base 12 such that it may rotate, and other means that allow rotary housing 14 to rotate might alternatively be employed. Notably, the device might be configured such that, for aesthetic reasons, ball thrust bearing 16 is inlaid such that it is hidden from view. Additionally, it should be appreciated that the rotary function of the device herein disclosed is merely preferred and provided as the best mode for practicing this invention, and this invention might also be practiced without the provision of a rotary function.

Rotary housing 14 is configured to receive a variety of golfing-related items. More particularly, rotary housing 14 is defined by top surface 20, bottom surface 22, and periphery 24. In the Figures, periphery 24 is generally circular, but such a configuration is merely preferred, and rotary housing 14 may take other shapes. A plurality of golf ball channels 26 extend from top surface 20 down toward bottom surface 22, where they end at rotary plate 28. Rotary plate 28 simply provides support for golf balls G that might be received in one of the plurality of golf ball channels 26, and, as such, rotary plate 28 may be integral with the remainder of rotary housing 14, although it is separately defined in the Figures herein. Notably, golf ball channels 26 partially open to periphery 24 of rotary housing 14. Golf ball channels 26 are configured in this manner such that, as best seen in FIG. 2, when golf balls G are received in channels 26, a portion of golf balls G extend beyond the periphery 24 of the rotary housing. More particularly, when received in this manner, novelty golf balls bearing logos or other indicia indicating the golf course at which they were purchased might be received in golf ball channels 26 SO as to display this logo or indicia through the open portion of the golf ball channels 26. With the capability of displaying golf course indicia printed on golf balls G, the function of display 10 as a conversation piece should be readily apparent, as should its utility as, alternatively, a sales display device.

Having disclosed, with respect to the preferred embodiment herein provided in the Figures, that golf balls G extend beyond the periphery 24 of rotary housing 14, it should be noted that, although less preferred, it is sufficient that the plurality of golf ball channels 26 partially open to the periphery 24 of rotary housing 14 such that a portion of a golf ball G received therein is viewable through the portion of the golf ball channel 26 that opens to said periphery 24 of said rotary housing 14, i.e., the invention is not to be limited to embodiments wherein the golf balls G would actually extend beyond the periphery 24. Additionally, it is also envisioned that golf ball channels 26 might open to the periphery 24 and provide shelves so as to be able to receive golf balls G through side loading, rather than top loading, as shown in the preferred embodiment of the Figures. Notably, such an embodiment would call for shelves to be provided in channels 26, because, other wise, the golf balls would stack upon each other and tend to move radially and fall out of the channels 26, due to the fact that the channels 26, in this alternative embodiment, are wide enough for radial side loading of the golf balls. The shelves would have to securely hold the golf balls G in order to prevent them from moving radially and falling out of the channels 26.

Base 12 and rotary housing 14 may be made of any suitable material; however, it is envisioned that fine woods might be employed to give display 10 a very elegant appearance. The dimensions of display 10 are also not critical; however, channels 26 should be configured as disclosed above to retain a golf ball while allowing for the display of a portion thereof at the periphery of rotary housing 14. The height of rotary housing 14 is not critical, but it is envisioned that a standard size would be such that three golf balls G (i.e., a sleeve) could be retained in each golf ball channel 26. Additionally, although dimensions are not to limit the present invention, the dimensions of display device 10 are preferably selected such that other golf-related items may be received therein, as described below.

The preferred embodiment of display device 10 further includes a score card slot 30, appropriately sized for receiving score cards S. In the particular embodiment of the Figures, display device 10 is small enough such that score card slot 30 is most appropriately positioned through the axis of rotary housing 14; however, the positioning thereof is to be non-limiting. As with golf balls G, score cards S may be displayed as conversation pieces, showing many of the courses that the owner of display device 10 has been to, or, when display device 10 is employed as a sales display at a golf course, the golf course may display score cards S that correspond to the courses that they maintain.

One or more utility slots 32 also extend downwardly into rotary housing 14 from top surface 20 thereof. Utility slots 32 are so named because their use might depend upon the way in which display device 10 is being employed, be it as a conversation piece or as a sales display. As a conversation piece, it is intended that utility slots 32, or at least one of them, serve to retain business cards B. This will be particularly useful when display device 10 is being employed as a conversation piece in an office or other setting in which it is common to request and exchange business cards. When display device 10 is employed as a sales display, particularly at a pro shop, it is envisioned that golf pencils P would be provided in utility slots 32. Of course, golfers may also collect course pencils P and, therefore, both business cards B and pencils P might be retained in utility slots 32. Indeed, the recitation of items to be placed in utility slot 32 should not be read as limiting the use of slots 32 in any particular manner.

Top surface 20 of rotary housing 14 is also preferably provided with means for receiving a divot repair tool. As with golf balls, pencils, business cards, and score cards, it is common for golf courses to provide divot repair tools that bear course-identifying indicia. Thus, such divot repair tools may be displayed for sale, when display device 10 is to be so employed, or displayed as conversation pieces, as the case may be. In FIGS. 1 and 2, the means for receiving a divot repair tool is identified generally by the numeral 34, and consists of two appropriately spaced bores, inasmuch as, as can be seen particularly in FIG. 1, divot repair tools D consist of two spaced prongs. Given the simple structure of divot repair tools D, it should be readily appreciated that slots or hangers or other means for receiving a divot repair tool D might be provided on display device 10.

Yet another item that is many times personalized for different golf courses is the ball marker M. Thus, it will be appreciated that, either for sales or conversation, it would be desirable to provide a means for displaying such ball markers M. In the embodiment herein, a plurality of periphery bores 36 are provided extending into rotary housing 14, from the periphery 24 thereof. Periphery bores 36 are appropriately dimensioned to snugly receive the pin portion of a typical ball marker M, such that the flat portion thereof, which typically bears the golf course indicia, is exposed towards one viewing display device 10. Although "periphery" bores 36 are employed in the preferred embodiment herein, it should be understood that bores could be provided elsewhere for ball markers M.

With respect to the forgoing, it should be understood that only a preferred embodiment has been particularly identified and disclosed, and certain particular aspects of this preferred embodiment need not be practiced to realize and appreciate the benefits of this invention. In light of the foregoing, it should more generally be appreciated that the present invention provides a display device for golfing-related items comprising a housing defining a periphery; a plurality of golfball channels partially open to said periphery and receiving golf balls therein such that said golf balls are viewable through the portion of the golf ball channels that opens to said periphery; and at least one item-retaining member selected from the group consisting of a score card slot retaining scorecards, a bore retaining ball markers, a pencil slot retaining score card pencils, a business card slot retaining business cards, and means retaining a divot repair tool. Thus, the housing need not be rotatable carried on a base; the golf ball channels need not be configured to cause a golf ball therein to extend beyond the periphery of the housing; the means for allowing the housing to rotate, when employed, need not be viewable between a base member and a housing member; and not all of the various retention members (score card slots, ball marker bores, utility slots, etc) need be employed on a single device.

It should be apparent that the invention herein, providing a display device for golfing-related items, substantially improves the art and provides a device that would be well-accepted by the golfing community. It should thus be evident that the process of the present invention, providing a display device for golfing-related items, substantially improves the art. While, in accordance with the patent statutes, only the preferred embodiments of the present invention have been described in detail hereinabove, the present invention is not to be limited thereto or thereby. Rather, the scope of the invention shall include all modifications and variations that fall within the scope of the attached claims.

What is claimed is:

1. In combination, a display device and a golf ball comprising:

a display including:

a base;

a rotary housing defining a periphery, said rotary housing being rotatably associated with said base, a plurality of golf ball channels partially open to said periphery of said rotary housing and capable of receiving golf balls therein, and a slot extending downwardly from said top surface of said rotary housing and selected from a group consisting of a scorecard slot and a utility slot, said scorecard slot for receiving a plurality of golfing scorecards, said utility slot for receiving items selected from business cards and golfing pencils; and a golf ball received in one of said plurality of golf ball channels, such that a portion of said golf ball is viewable through the portion of the golf ball channel that opens to said periphery of said rotary housing.

2. The combination of claim 1, wherein said plurality of golf ball channels provide an opening at a top surface of said rotary housing and receive golf balls at said opening.

3. The combination of claim 1, wherein said golf ball extends beyond the periphery of said rotary housing.

4. In combination 1, a display device and a golf ball comprising:

a display including:

a base, a rotary housing defining a periphery, said rotary housing being rotatably associated with said base, a plurality of golf ball channels partially open to said periphery of said rotary housing and capable of receiving golf balls therein, and a scorecard slot extending downward from said top surface of said rotary housing for receiving a plurality of golfing scorecards; and a golf ball received in one of said plurality of golf ball channels, such that a portion of said golf ball is viewable through the portion of the golf ball channel that opens to said periphery of said rotary housing.

5. The combination of claim 4, further comprising:

a utility slot extending downward from said top surface of said rotary housing for receiving items selected from a plurality of business cards and golfing pencils.

6. The combination of claim 5, further comprising:

a plurality of bores extending into said rotary housing for receiving ball markers.

7. The combination of claim 6, wherein said plurality of bores extend into said rotary housing from said periphery of said rotary housing.

8. The combination of claim 7, further comprising:

means for receiving a divot repair tool.

9. A display device for golfing-related items comprising:

a housing defining a periphery;

a plurality of golf ball channels, each partially open to said periphery and receiving a plurality of golf balls therein such that said plurality of golf balls are viewable through the portion of said plurality of golf ball channels that opens to said periphery; and at least one item-retaining member selected from the group consisting of:

(a) a score card slot retaining scorecards, (b) a bore retaining ball markers, (c) a pencil slot retaining score card pencils, and (d) a business card slot retaining business cards.

* * * * *